US005806713A

United States Patent [19]

Dudley et al.

[11] Patent Number: 5,806,713

[45] Date of Patent: Sep. 15, 1998

[54] SELF-ADHESIVE STAMP DISPENSING DEVICE

[76] Inventors: Peter B. Dudley, 16359 Shady View La., Los Gatos, Calif. 95032; Edmond R. Dudley, 19941 Lanark La., Saratoga, Calif. 95070

[21] Appl. No.: 641,167

[22] Filed: Apr. 29, 1996

[51] Int. Cl.[6] ..... B65H 5/28

[52] U.S. Cl. ..... 221/73; 156/541; 156/584

[58] Field of Search ..... 156/584, 540, 156/541, 577; 221/22, 26, 73

[56] References Cited

U.S. PATENT DOCUMENTS

| | | | |
|---|---|---|---|
| 2,569,140 | 9/1951 | Avery | 156/541 |
| 3,222,242 | 12/1965 | Ingalls et al. | 221/73 X |
| 3,686,055 | 8/1972 | Hermann | 221/73 X |
| 4,111,735 | 9/1978 | Hamisch | 156/577 |
| 4,116,746 | 9/1978 | Hamisch | 156/541 |
| 4,330,357 | 5/1982 | Collins | 156/584 |
| 4,496,049 | 1/1985 | Pabodie et al. | 221/73 X |
| 4,505,773 | 3/1985 | Sato et al. | 156/577 |
| 4,570,868 | 2/1986 | Wiggs et al. | 221/73 X |
| 4,772,355 | 9/1988 | Leahy | 156/584 |
| 4,859,275 | 8/1989 | Sueda | 156/541 |
| 4,954,210 | 9/1990 | Desmond | 221/73 |
| 5,045,145 | 9/1991 | Becker | 156/584 |

FOREIGN PATENT DOCUMENTS

| | | | |
|---|---|---|---|
| 45-7586 | 3/1970 | Japan | 156/584 |
| 937042 | 9/1963 | United Kingdom | 221/73 |

*Primary Examiner*—H. Grant Skaggs

[57] ABSTRACT

A device for dispensing and applying stamps, labels, stickers, and other self-adhesive products mounted on a backing web. Sliding the device across a contacting surface rotates the single moving part, a drive roller. The drive roller pulls the backing web around a delaminating bend. This separates the self-adhesive product from the web and applies it to the contacting surface. Some embodiments of the invention discharged the used webbing. The other embodiments automatically collect and store the webbing within their housings.

6 Claims, 6 Drawing Sheets

SELF-ADHESIVE STAMP DISPENSING DEVICE

FIELD OF THE INVENTION

This invention relates to a manually operable label dispensing device, particularly for dispensing and applying pressure sensitive postage stamps.

BACKGROUND TO THE INVENTION

Pressure sensitive self-adhesive labels and stickers have been widely used for many years. Recently the United States Postal Service has introduced postage stamps that are self-adhesive. The stamps come mounted on sheets of backing cardstock equal in size to a dollar bill. Eighteen stamps are mounted on each card. Like pressure sensitive labels and stickers, each self-adhesive stamp is peeled off the card and then applied to the package or envelope.

SUMMARY OF THE INVENTION

The present invention provides an improved method of dispensing and applying self-adhesive postage stamps. With this device the application of these stamps is much faster and easier, than the current peel and apply method. To use the present invention to apply stamps, the stamps would need to become available in rolls. Rolls of self-adhesive stamps offer several advantages over sheets of self-adhesive stamps. Instead of just 18 stamps, each roll could be available in quantities of 50 to 100 stamps. The cost of manufacturing rolls of stamps should be less than sheets of stamps. A roll of stamps requires only a thin backing web. While the cardstock backing for sheet stamps is approximately twice as thick. Card mounted stamps thus require significantly more material, which usually results in higher cost. With over a billion self-adhesive stamps sold each year, the savings to the U. S. Postal Service may amount to millions of dollars.

The manufacturing cost of the applicators should be low. They are compact in size and simple in design. They essentially consist of a housing and one moving part, a drive roller. Moving the applicator over the surface of an envelope or package turns this drive roller. The turning drive roller pulls the backing web across a delaminating surface resulting in the removal and application of the stamp. The drive roller floats within the housing of the applicator. Because it floats the drive roller can tightly grip the backing web. It grips the web between itself and an opposing stationary surface during stamp application. When refilling the device the web is rethreaded around the drive roller. The floating of the drive roller makes this rethreading easy.

There are several embodiments of the applicator. They differ principally on their handling of the used backing web. The simplest and most compact embodiment discharges the used webbing as it applies each stamp. The discharged webbing can then be torn off and thrown away. The second embodiment only discharges webbing after applying a group of stamps. As the last stamp of the group is applied a short piece of webbing is discharged. Pulling on this piece will cause all of the webbing from the group to be cut off. No further webbing is discharged until the last stamp from the next group is applied. Each group consists of approximately six stamps.

The third embodiment does not discharge the used webbing. Instead, all of the used webbing is stored within the applicator. The webbing is first guided into forming a small roll. As additional webbing is added to the outside of this roll, its diameter increases. To accommodate the increasing roll diameter, a part of the web guide expands. The guide will expand until all of the used webbing has been stored. The roll of stored used webbing, is removed when the applicator is refilled with a new roll of stamps.

The preferred embodiment also stores all of the used webbing. The webbing is also stored in a roll, but the roll is formed by a different method Instead of guiding the webbing directly into a roll, the webbing is guided into a small radius curve. A curl is put into the webbing when it is forced to follow this curve. As the used webbing accumulates, the curl in it causes the webbing to form into a compact roll. And like the third embodiment, the used webbing is stored within the applicator, until the applicator is refilled with fresh stamps.

With many previous applicators that store the used webbing, the webbing is wrapped up on a spool. For example several U.S. Pat. Nos. 3,222,242 (1965) Ingalls; 4,570,868 (1986) Wiggs; and 4,954,210 (1990) Desmond, all use spools to wrap up the used webbing. The spool adds another part and increased cost to either the applicator or the self adhesive product. If the spool comes with the self-adhesive product; it adds to the cost to every refill. If it is part of the applicator; then it adds additional steps to refilling the applicator. First the used backing must be removed from the spool. Next the new backing must be attached in some manner to the spool. The last two embodiments of this invention are unique. They accumulate the used webbing without the use of spools.

The simplicity, ease of use, and low cost are shared by all of the embodiments of the present invention. This makes them all very suitable for applying self-adhesive postage stamps. These same features are also needed for applicators of other pressure sensitive self-adhesive products, such as labels stickers, and hole reinforcements. It is anticipated that versions of this device will find uses in several areas of the self-adhesive product application market.

OBJECTS AND ADVANTAGES

It is an object of the present invention to provide an inexpensive manually operable dispensing device for self-adhesive postage stamps.

Several additional objects and advantages of the present invention are:

(a) to provide an enclosure to protect the stamps until they are applied;

(b) to provide a stamp applicator that is easy to use;

(c) to provide a device that will conveniently hold 50 to 100 stamps;

(d) to provide an applicator that can store the used backing web;

(e) to provide an applicator that can be adapted to apply labels, stickers or hole reinforcements;

These and other objects and advantages of the present invention will no doubt become obvious to those of ordinary skill in the art after having read the following detailed description of the embodiments which are illustrated in the various drawing figures.

DETAILED DESCRIPTION

Figure 1:
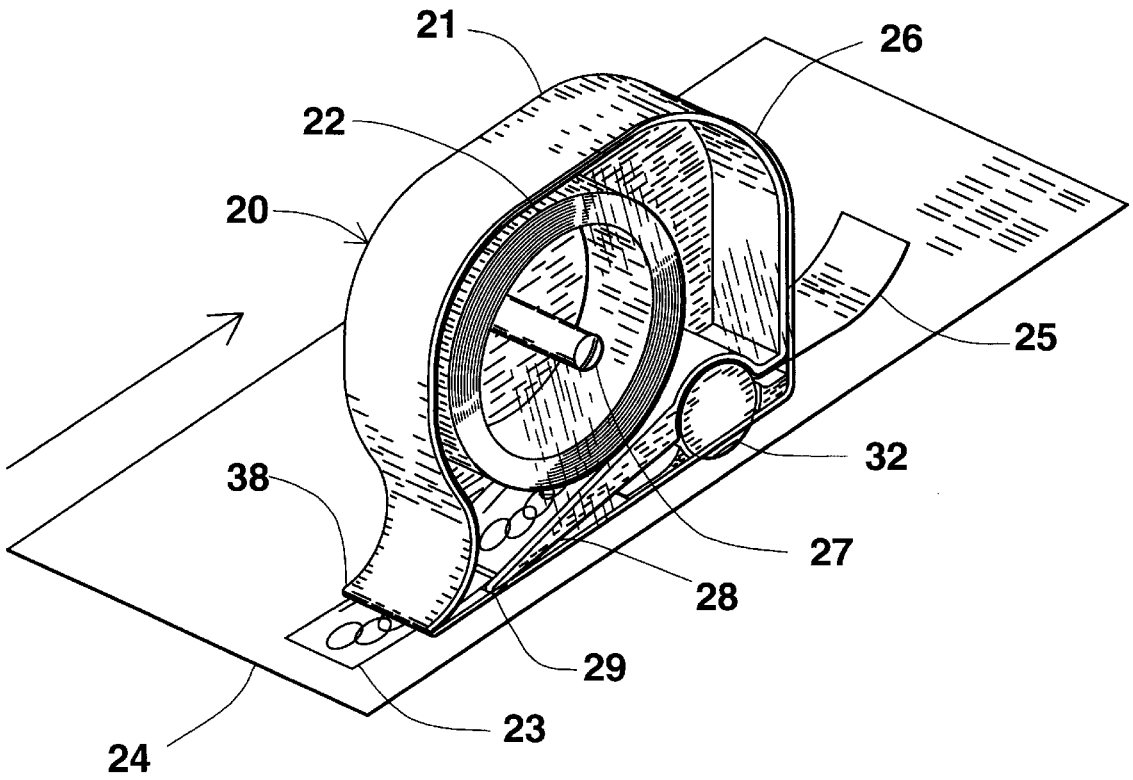
FIG. 1 is a perspective view of the first embodiment of the stamp applicator.
Figure 2:
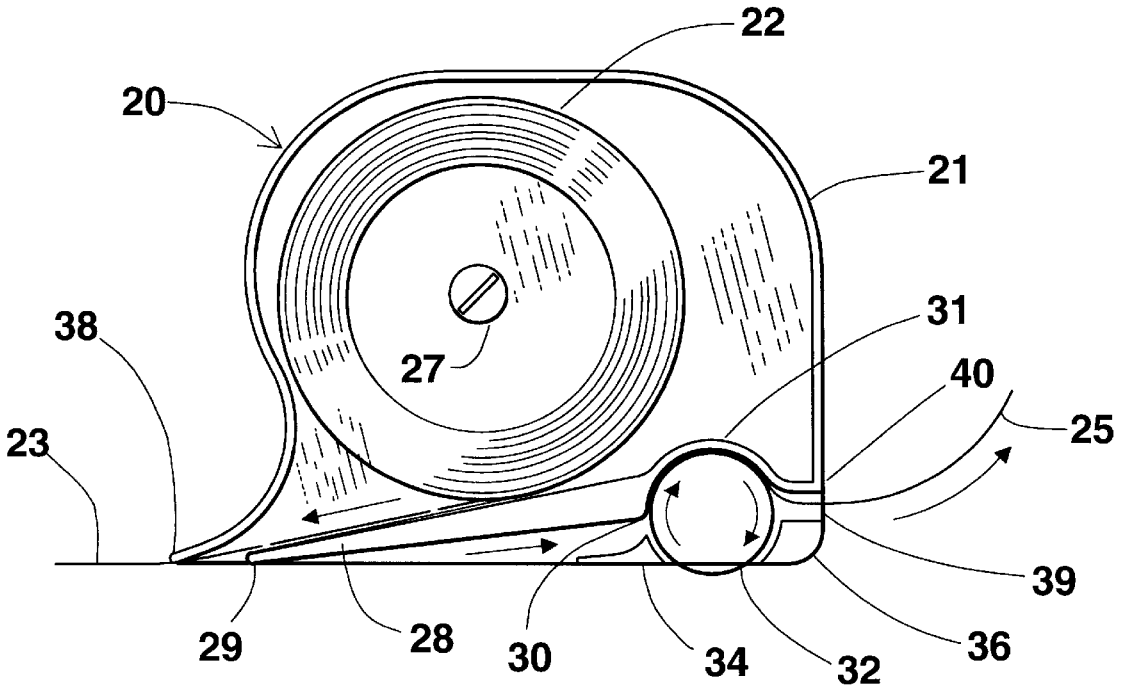
FIG. 2 is a side view of the first embodiment.

With reference to FIGS. 1 and 2, a first embodiment of a self-adhesive stamp dispensing device is indicated by the general reference character 20. This device is formed with a rigid plastic housing 21 and a removable cover 26. The cover can be removed by loosening a screw 27 to allow replacement of a roll of stamps 22. Many other common methods of attaching a separate cover to a housing could also be used. Or, the cover and the housing could be made as a single piece part. Using the appropriate material, the plastic connecting the cover to the housing could function as a hinge. The cover would close over the housing and be held in the closed position by a locking mechanism molded into the parts. The roll 22 consists of self-adhesive postage stamps 23 on the inner surface of backing paper 25. During operation the backing paper 25 follows the path indicated by the arrows. The backing paper 25 with the attached stamps 23 travels along the top of an angled guide 28. As the backing is pulled around delaminating edge 29 the stamp separates from it. The adhesive surface of the stamp is then able to come in contact with an envelope 24. The housing end 38, presses the stamp firmly onto the envelope 24. After separating from the stamps the backing paper continues towards the rounded corner 30. From there, it passes between an arcuate section 31 and a drive roller 32 and is expelled out of the opening in the rear of the housing 39.

The drive roller 32 is loosely confined by a forward roller holder 34 and a rearward roller holder 36. The drive roller 32 is loosely confined for two purposes. First, it allows the roller 32 to move away from arcuate section 31. This separation allows the backing to be easily threaded between them when a new roll of stamps is being placed in the device. Secondly, it allows the drive roller 32 to move up into the arcuate section 31. The inside diameter of the arcuate section 31 and the outside diameter of the drive roller 32 are substantially the same. When the drive roller moves into this arcuate section the backing paper is pinched between them. The arcuate section 31 is smooth and there is little friction between it and the backing paper. The outside circumference of the drive roller is made of high friction material so that it can grip the backing paper when the roller rotates.

In operation, the stamp dispenser 20 is placed on an envelope laying on a hard flat surface, such as a desk. A slight downward pressure causes the drive roller 32 to pinch the backing paper 25 between it and the arcuate section 31. Moving the dispenser backward causes the drive roller to rotate, and it pulls the backing paper through the device. The stamp 23 is separated from the backing paper as the paper rounds the delaminating edge 29 and is applied to the envelope. The front edge 38 of the housing presses the stamp firmly onto the enveloped. The used backing paper 25 is ejected out of the opening 39. A cutting edge 40 is located at the top of the opening 39. The cutting edge 40 is similar to that used on an adhesive tape dispenser. When the used backing paper becomes excessive it can be torn off by holding the drive roller 32 from turning and pulling the excess backing paper across cutting edge 40.

Figure 3:
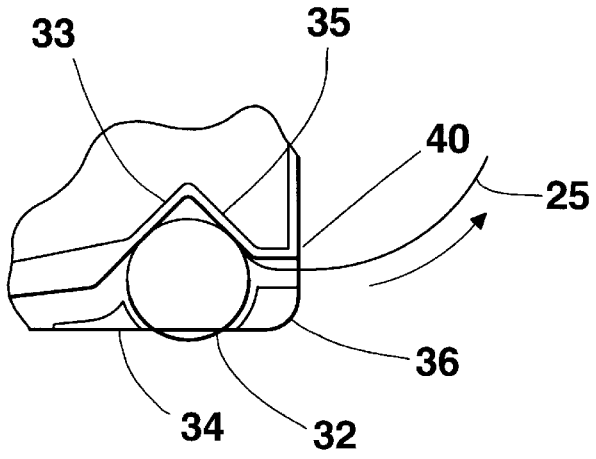
FIG. 3 is a fragmentary side view of the device showing an alternate drive roller and stationary surface configuration.

FIG. 3 shows an alternate drive roller and stationary surface configuration. In this approach the empty backing paper 25 is gripped between drive roller 32 and two flat stationary surfaces 33 and 35. Such an arrangement might be used if the device were fabricated from cardboard instead of plastic.

Figure 4:
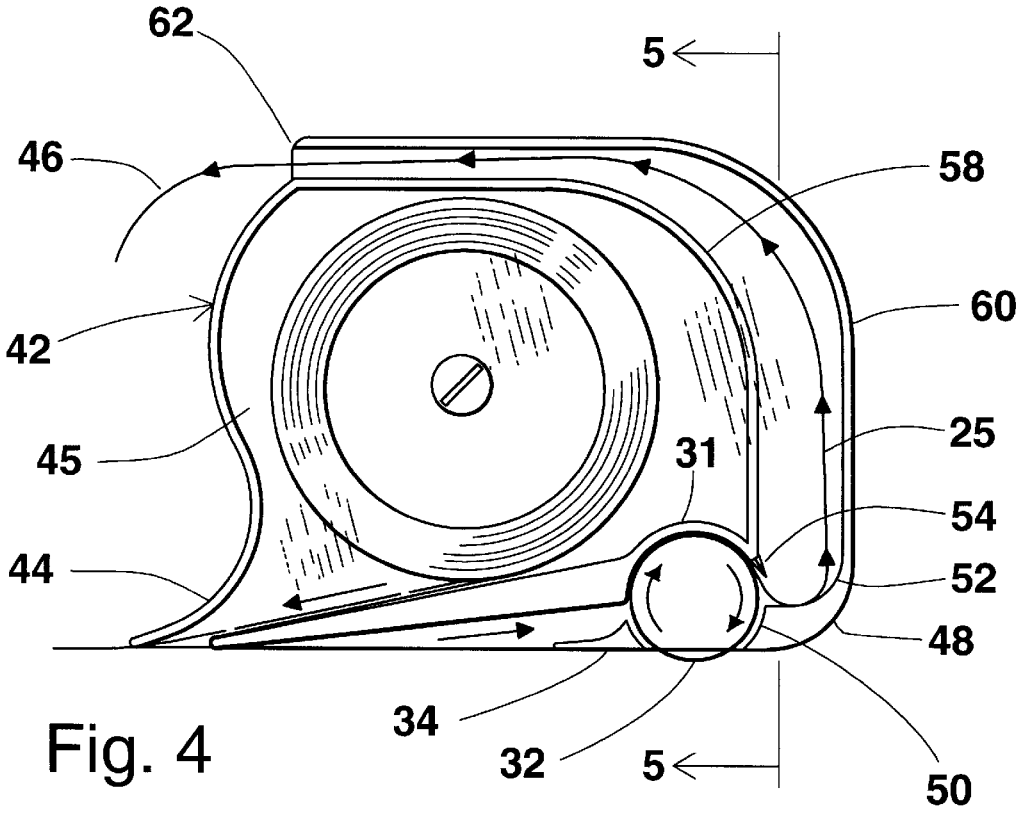
FIG. 4 is a side view of the second embodiment which has limited backing web storage.
Figure 5:
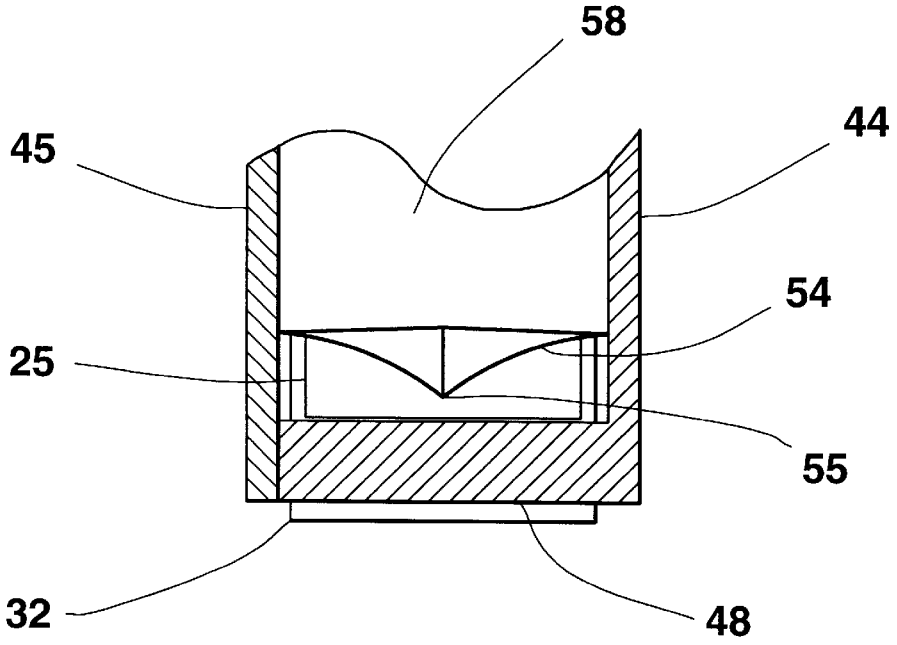
FIG. 5 is an enlarged partial sectional view on line 5—5 of FIG. 4 showing the detail of a pointed backing web cutter.

The arcuate section 31 is the preferred shape for gripping the backing with the roller 32 and it is the one used with the four embodiments described herein. Each embodiment of the invention applies stamps in the same manner as described for the first embodiment. The principal differences between the embodiments is in how they handle the used backing paper after it has been through the drive roller. FIGS. 4 and 5 depict a second embodiment generally referenced 42, which provides limited storage for the used backing paper. Second embodiment 42 is formed with a rigid plastic housing 44 and removable cover 45. Drive roller 32 is loosely confined by forward roller holder 34 and rearward roller holder 48. The backing paper 25 follows the same path as the first embodiment until it passes the arcuate section 31. After passing arcuate section 31 the backing is deflected upward by arcuate section 52. It then follows the curved channel formed between inner channel wall 58 and outer channel wall 60. The backing follows the channel and is expelled at the opening 62. When sufficient empty backing has accumulated as shown as 46 it can be pulled and it will be cut off at the paper cutter 54. Point 55 of cutter 54 pierces the backing paper 25 when the backing paper is pulled up against it. Continued pulling of the backing paper will cause the paper to tear off at the cutter 54. Approximately six to eight stamps could be dispensed before the used backing will accumulate to an amount shown as 46.

Figure 6:
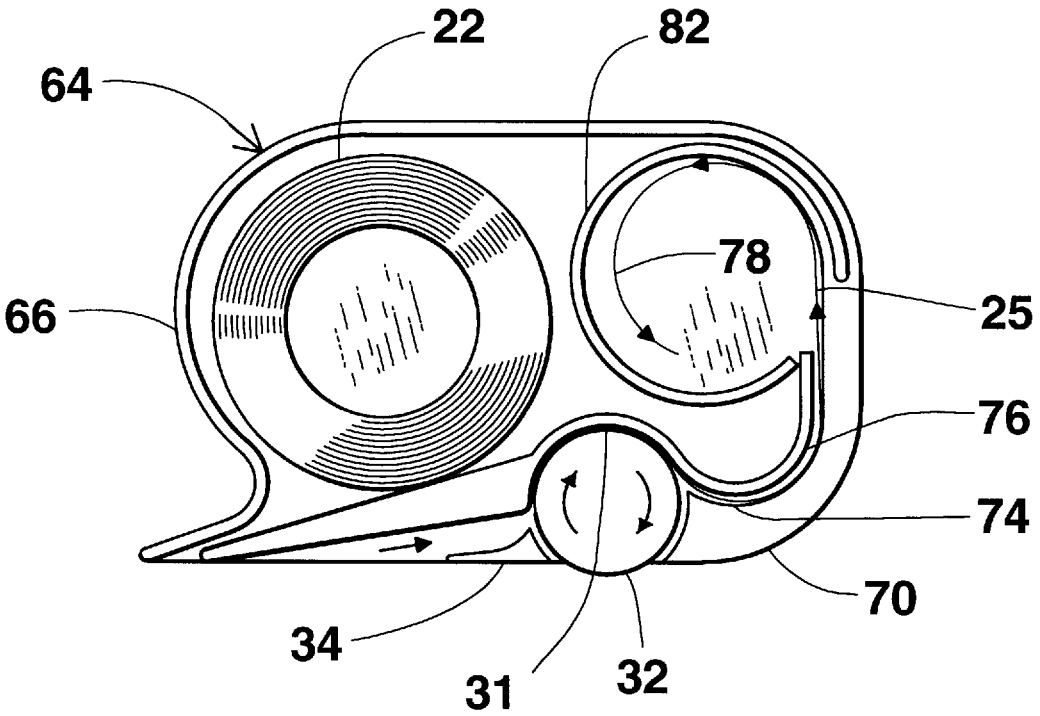
FIG. 6 is a side view of the third embodiment with a nearly full roll of stamps and a small accumulation of used backing web.
Figure 7:
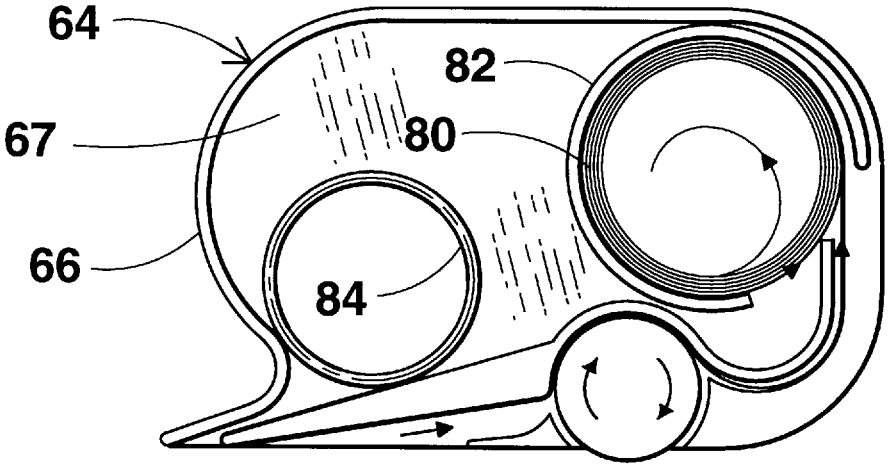
FIG. 7 is a side view of the third embodiment with a nearly empty roll of stamps and a nearly full roll of used backing web.

FIGS. 6 and 7 depict a third embodiment generally referenced 64 which provides full storage for the empty backing paper. This embodiment 64 is formed with a rigid plastic housing 66 and removable cover 67. Drive roller 32 is loosely confined by forward roller holder 34 and rearward roller holder 70. After the backing paper 25 passes the arcuate section 31 it follows the channel formed by arcuate sections 74 and 76. The backing paper 25 is directed into the area circumscribed by arcuate section 82. Arcuate section 82 behaves as a very low force spring. In FIG. 6 it is fully compressed as the empty backing paper is just beginning to enter as shown as 78. The arcuate section guides the backing paper into forming a roll whose diameter increases as more backing paper accumulates. The arcuate section expands to accommodate the growing diameter of this roll. In FIG. 7 arcuate section 82 is nearly fully expanded. Nearly all of the backing has been accumulated in the roll 80. Only a few stamps remain in stamp roll 84. After the last stamp has been applied the cover 67 is removed and the accumulated backing 80 can be easily taken out and discarded or recycled. The device can then be easily refilled with a new roll of stamps.

Figure 8:
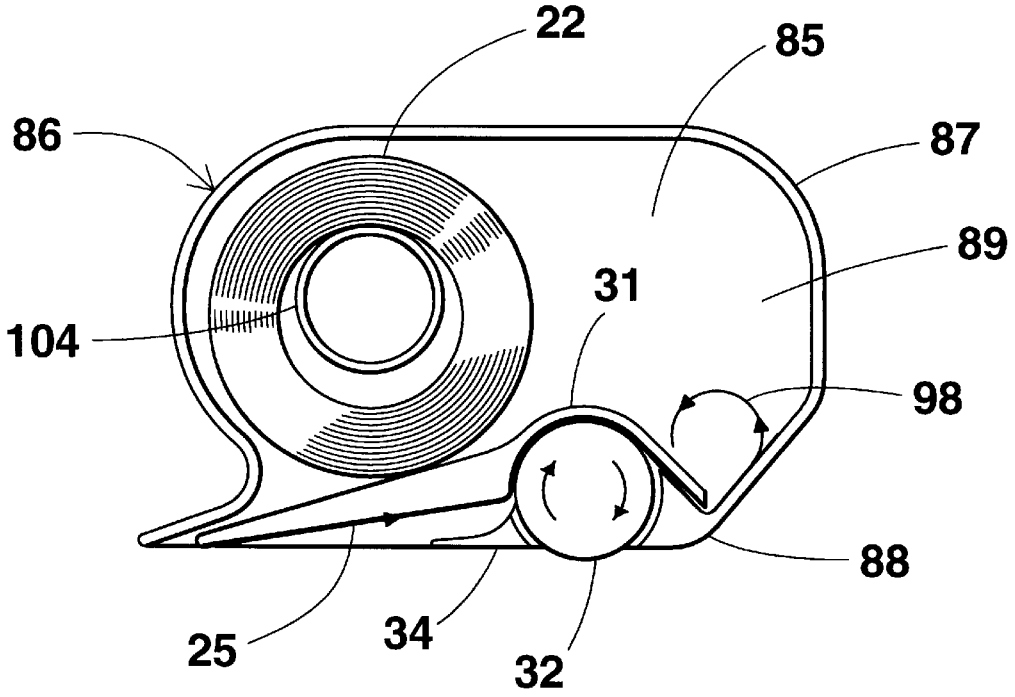
FIG. 8 is a side view of the preferred embodiment with a full roll of stamps.
Figure 9:
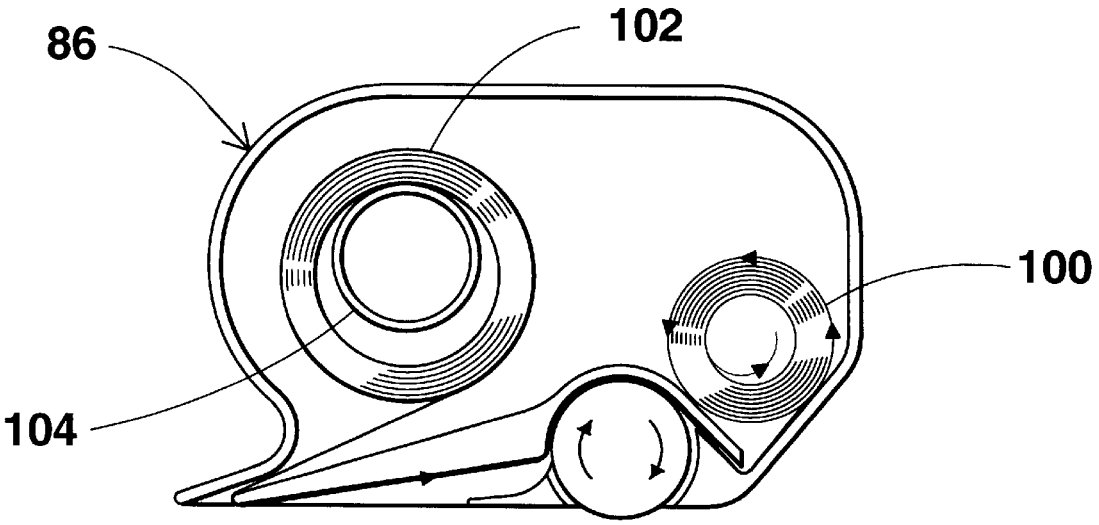
FIG. 9 is a side view of the preferred embodiment with a half roll of stamps and a half roll of used backing web accumulated.
Figure 10:
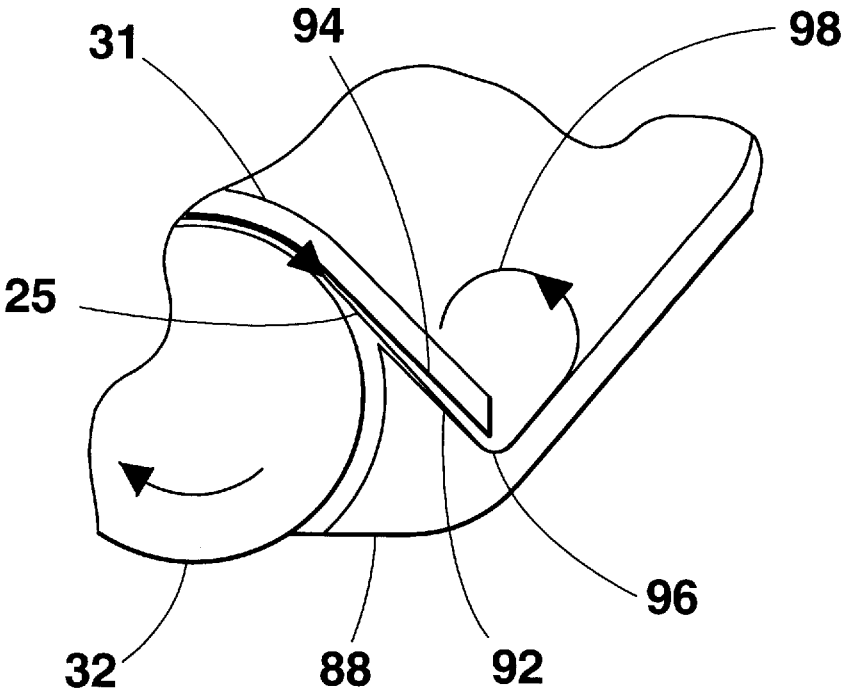
FIG. 10 is an enlarged fragmentary sideview of the preferred embodiment showing where a curl is put into the used backing web.

FIGS. 8, 9 and 10 depict the preferred embodiment generally referenced 86 which also provides full storage for the empty backing paper. This embodiment 86 is formed with a rigid plastic housing 87 and removable cover 89. Drive roller 32 is loosely confined by forward roller holder 34 and rearward roller holder 88. After the backing paper 25 passes the arcuate section 31 it follows the channel formed by straight sections 92 and 94. This channel guides the empty backing paper into the small radius arcuate section 96. As the paper is forced to follow the small radius 96 a curl is formed into the paper 98. A curl continues to be formed into all of the backing paper that follows the small radius 96. As more of this curled backing paper accumulates it will form into a roll 100.

FIG. 8 shows the preferred embodiment with a fresh roll of stamps 22. The roll of stamps is mounted on a cylinder 104. An interior space 85 is provided for storage of the used backing paper, the curled end of which is shown as 98. In FIG. 9 the roll of stamps have been half used 102 and the backing as accumulated into a roll 100. When all of the stamps have been used the cover can be opened and the roll of empty backing paper can be quickly removed. If a new roll of stamps can be provided with a leader of empty backing then; it could be quickly threaded into the device and ready to use again in a few seconds. This is possible because with the cover open, the backing paper travel path shown with arrows is assessable from the side. Also the drive roller 32 is floating and provides ample room to thread the backing paper between the roller and the arcuate section 31.

Figure 11:
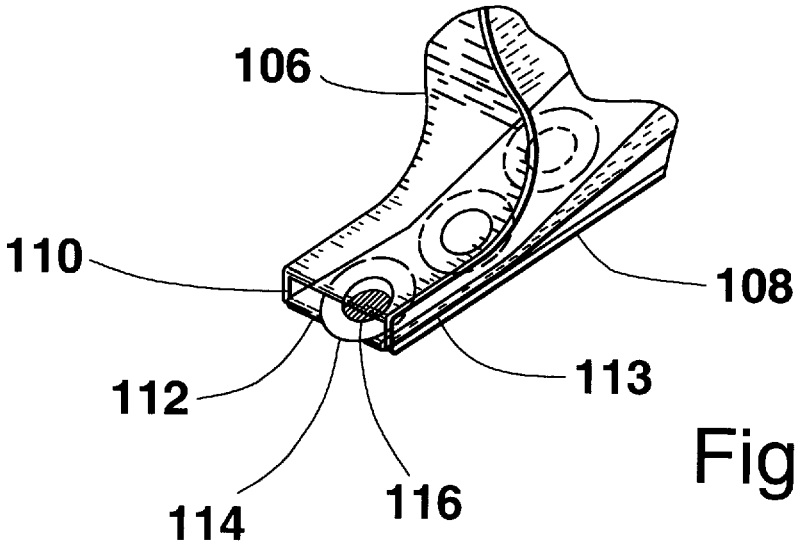
FIG. 11 is a fragmentary perspective view showing an extended delaminating edge.

While the description of the invention has been limited to applying postage stamps; it is apparent that the invention could be adapted to apply a variety of self-adhesive products. One of these adaptations is shown in FIG. 11. This adaptation would be useful for products that need to be applied accurately. To facilitate accuracy the delaminating edge 112 is at the end of a clear extension 113. A clear housing 106 and cover 108 have been extended to form a guide channel 110. In FIG. 11 the application of a hole reinforcement 114 about the punched paper hole 116 is depicted. With a clear backing material the user is able to see where the self-adhesive product, in this instance a hole reinforcement, will be applied.

SUMMARY, RAMIFICATIONS, AND SCOPE

It can be seen that the applicator of this invention is very suitable for applying pressure sensitive self-adhesive postage stamps. Additionally the invention could be used for applying a variety of other self-adhesive products. For many applications, including stamps, the need for a disposable version of this invention would be desirable. Because of the basic simplicity of the invention it can be easily adapted to be disposable.

An obvious modification would to make the drive roller hollow. A coated plastic or paperboard cylinder, or a cylinder with a textured surface could be substituted for the solid drive roller. The housing can also be changed. It does not need to be made from plastic. Paperboard could be substituted for part or all of the housing. A folded paperboard box with metal or plastic inserts may be the least costly method to make the housing. The purpose of the inserts would be for tearing off the used webbing. Inserts may also be advantageous for the stationary surface opposing the drive roller.

The housing could be modified in another manner to reduce costs. In the descriptions solid walls are shown. The function of much of the housing is to hold the roll of stamps and the drive roller. This does not require a solid wall to accomplish. Plastic material and cost could be saved if the walls were made with openings. The product could be loaded into the applicator through an opening in one of the walls. The size and shape of the opening would allow the roll of product to be inserted when the roll was compressed. But after it was released the roll would rebound to its circular shape and not be able to pass back out of the opening. With this modification the housing could be a single piece part without a separate or hinged cover.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather that by the examples given.

We claim:

1. Manually operable device for dispensing and applying stamps, labels or other pressure sensitive adhesive products, that are adhered to a backing web comprising:

a housing for accepting a supply of backing web having stamps, labels or other pressure sensitive adhesive products adhered thereto;

an opening in said housing though which said pressure sensitive adhesive products are dispensed;

a delaminating means for delaminating said pressure sensitive adhesive products from said backing web as said web is pulled through said device;

a drive means for pulling said web through said device;

said drive means comprising a rigid stationary member and an adjacent floating drive roller;

means for maintaining the axial angular position of said floating drive roller, substantially constant, relative to said housing;

said floating drive roller being sufficiently displaceable to allow the threading of said backing web between said floating drive roller and said rigid stationary member when said device is being reloaded;

a portion of the periphery of said floating drive roller extending beyond the perimeter of said housing;

whereby during the application of a pressure sensitive adhesive product, said dispenser and said floating drive roller are placed upon a flat surface which forces said floating drive roller toward said rigid stationary member, gripping said threaded backing web between said floating drive roller and said rigid stationary member with a force directly proportionally to the force applied upon said flat surface by said floating drive roller, whereupon moving said dispenser across said surface rotates said floating drive roller, pulling said gripped backing web through said device and dispensing said pressure sensitive adhesive product.

2. Manually operable device as defined in claim 1, wherein the rigid stationary member is an arcuate shaped wall;

the inner radius of said arcuate shaped wall being substantially equal to the radius of said floating drive roller;

said arcuate shaped wall and said floating drive roller being generally concentric.

3. Manually operable device as defined in claim 1, wherein the rigid stationary member is comprised of two substantially flat walls;

said walls being substantially tangent to said floating drive roller and at an acute angle to each other.

4. Device for dispensing and applying stamps, labels or other pressure sensitive adhesive products, that are adhered to a backing web comprising:

a housing for accepting a supply of backing web having stamps, labels or other pressure sensitive adhesive products adhered thereto;

an opening though which said pressure sensitive adhesive products are dispensed;

a delaminating means for delaminating said pressure sensitive adhesive products from said backing web as said web is pulled through said device;

a drive means for pulling said web through said device;

wherein the improvement comprises a compact storage means for storing segments of used web;

said storage means comprising a web cutter and a channel with input and discharge openings;

said web cutter is proximate said input opening;

said input opening is adjacent said drive means and said channel is positioned to receive said used web from said drive means;

the length of said channel between said input and said discharge openings is sufficient to accommodate the used webbing from several applied self adhesive products before the end of said webbing emerges from said discharge opening;

whereupon pulling on said end of said emerged webbing causes the segment of said used web to be cut off by said web cutter as said web segment is pulled from said channel.

5. Device for dispensing and applying stamps, labels or other pressure sensitive adhesive products, that are adhered to a backing web comprising:

a housing for accepting a supply of backing web having stamps, labels or other pressure sensitive adhesive products adhered thereto;

an opening though which said pressure sensitive adhesive products are dispensed;

a delaminating means for delaminating said pressure sensitive adhesive products from said backing web as said web is pulled through said device;

a drive means for pulling said web through said device;

wherein the improvement comprises a compact means of storing used backing web;

said storage means comprising a guide channel and a springably expandable arcuate section;

the first opening of said guide channel is adjacent said drive means and the second opening of said guide channel is substantially tangent to the inner surface of said arcuate section;

said guide channel directs the used web from said drive means to said inner surface of said arcuate section;

as said used web enters said arcuate section it follows said inner surface of said arcuate section and forms into a small roll;

a suitably small force is required to expand said arcuate section;

whereby as additional used web is coiled onto said roll, said arcuate section readily expands with little friction being applied to the outside surface of said roll of used web, allowing the storage of a great amount used backing web.

6. Device for dispensing and applying stamps, labels or other pressure sensitive adhesive products, that are adhered to a backing web comprising:

a housing for accepting a supply of backing web having stamps, labels or other pressure sensitive adhesive products adhered thereto;

an opening though which said pressure sensitive adhesive products are dispensed;

a delaminating means for delaminating said pressure sensitive adhesive products from said backing web as said web is pulled through said device;

a drive means for pulling said web through said device;

wherein the improvement comprises a compact means of storing used backing web;

said storage means comprising a guide channel and a rigid arcuate section;

the first opening of said guide channel is adjacent said drive means and the second opening of said channel is substantially tangent to the inner surface of said rigid arcuate section;

said guide channel directs the used webbing from the drive means and forces it into said inner surface of said arcuate section;

said arcuate section being of a suitably small radius to cause a curl to be formed into the backing web material as said used webbing is forced into said small radius;

whereby as a curl continues to be impressed into additional used webbing said webbing coils up into a compact roll.

* * * * *